US007975517B2

(12) United States Patent
Liu et al.

(10) Patent No.: US 7,975,517 B2
(45) Date of Patent: Jul. 12, 2011

(54) MULTISTAGE LOCK APPARATUS

(76) Inventors: Wen-Kuei Liu, Taichung (TW); Chao-Hsuan Liu, Tanzi Township, Taichung County (TW); Yu-Chun Liu, Tanzi Township, Taichung County (TW)

( * ) Notice: Subject to any disclaimer, the term of this patent is extended or adjusted under 35 U.S.C. 154(b) by 106 days.

(21) Appl. No.: 12/558,805

(22) Filed: Sep. 14, 2009

(65) Prior Publication Data

US 2011/0061430 A1 Mar. 17, 2011

(51) Int. Cl.
*E05B 37/02* (2006.01)

(52) U.S. Cl. ..... 70/292; 70/293; 70/303 A; 70/306; 70/310; 70/328; 70/329; 70/332

(58) Field of Classification Search ..... 70/301, 70/302, 303 R, 303 A, 304–306, 309, 312, 70/329, 332, 292, 293, 310, 327, 328, 443–445
See application file for complete search history.

(56) References Cited

U.S. PATENT DOCUMENTS 613,280 A * 11/1898 Johnson ..... 70/309
897,228 A * 8/1908 Soley ..... 70/309
1,158,152 A * 10/1915 Albanese ..... 70/133
1,194,286 A * 8/1916 Gorham ..... 70/292
1,320,806 A * 11/1919 Sungail ..... 70/312
2,925,726 A * 2/1960 Miller ..... 70/333 R
3,098,376 A * 7/1963 Miller ..... 70/333 R
3,423,970 A * 1/1969 Harrell ..... 70/156
4,104,896 A * 8/1978 Hahn ..... 70/310
4,376,380 A * 3/1983 Burgess ..... 70/303 A
5,575,164 A * 11/1996 Ohsawa ..... 70/303 A
7,383,708 B2 * 6/2008 Liu et al. ..... 70/310

* cited by examiner

*Primary Examiner* — Lloyd A Gall
(74) *Attorney, Agent, or Firm* — C. G. Mersereau; Nikolai & Mersereau, P.A.

(57) ABSTRACT

A multistage lock apparatus has a base, a disk holder, two selecting devices, two disk sets and at least one interfering element. The base has a mounting panel and a central tube. The disk holder is connected to the base and has a mounting beam, two extending beams, a middle beam, a connecting beam and two mounting spaces. The selecting devices are rotatably connected to the base. The disk sets are respectively mounted on the selecting devices in the mounting specs of the disk holder and each disk set has a driving disk and at least one driven disk. The at least one interfering element is mounted securely on the disk holder and each of the at least one interfering element has a mounting tab and two elastic panels.

8 Claims, 7 Drawing Sheets

MULTISTAGE LOCK APPARATUS

BACKGROUND OF THE INVENTION

1. Field of the Invention

The present invention relates to a multistage lock apparatus that can provide a preferred structure strength and safety.

2. Description of Related Art

A conventional multistage lock apparatus applied for a lock assembly comprises a base, a selecting disk and a disk set. The base is mounted on the lock assembly. The selecting disk is rotatably mounted on the base and has a driving rod extending through the base. The disk set is connected to the driving rod and has four disks. However, the structure strength of the conventional multistage lock apparatus is weak, and this will decrease the safety of using the conventional multistage lock apparatus. Furthermore, the conventional multistage lock apparatus has only one disk set including four disks, to unlock the multistage lock apparatus only needs four passwords, is easy and takes few time for an unauthorized person. In addition, the unauthorized person can use an electric sound collector or a stethoscope to rotate the disks in the unlock positions, and this will decrease the safety of using the conventional multistage lock apparatus. Therefore, the safety of using the conventional multistage lock apparatus needs to be improved.

SUMMARY OF THE INVENTION

The main objective of the invention is to provide a multistage lock apparatus with a preferred structure strength and safety.

The multistage lock apparatus has a base, a disk holder, two selecting devices, two disk sets and at least one interfering element. The base has a mounting panel and a central tube. The disk holder is connected to the base and has a mounting beam, two extending beams, a middle beam, a connecting beam and two mounting spaces. The selecting devices are rotatably connected to the base. The disk sets are respectively mounted on the selecting devices in the mounting specs of the disk holder and each disk set has a driving disk and at least one driven disk. The at least one interfering element is mounted securely on the disk holder and each of the at least one interfering element has a mounting tab and two elastic panels.

DETAILED DESCRIPTION OF PREFERRED EMBODIMENT

Figure 1:
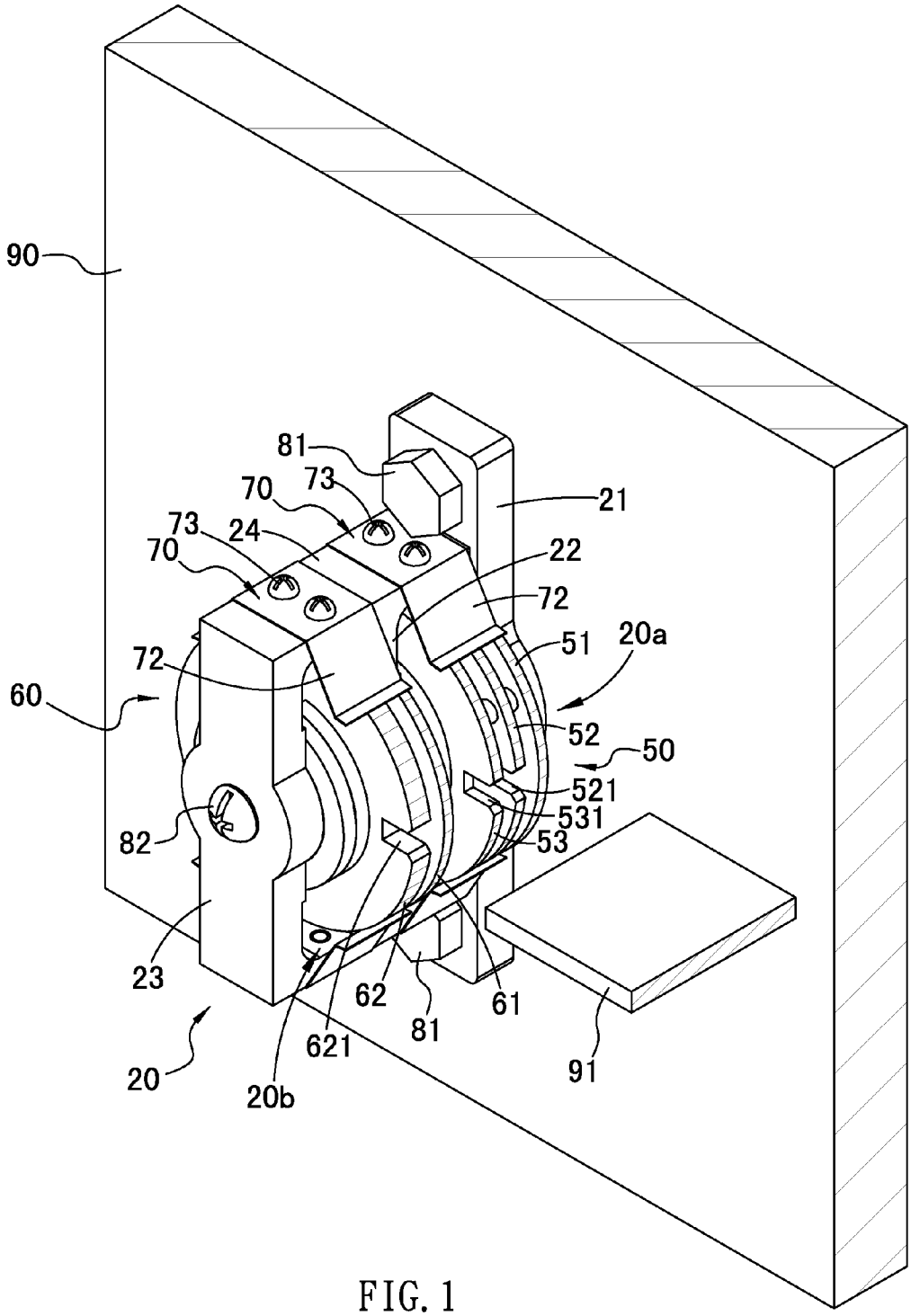
FIG. 1 is a perspective view of a multistage lock apparatus in accordance with the present invention mounted on a lock assembly.
Figure 2:
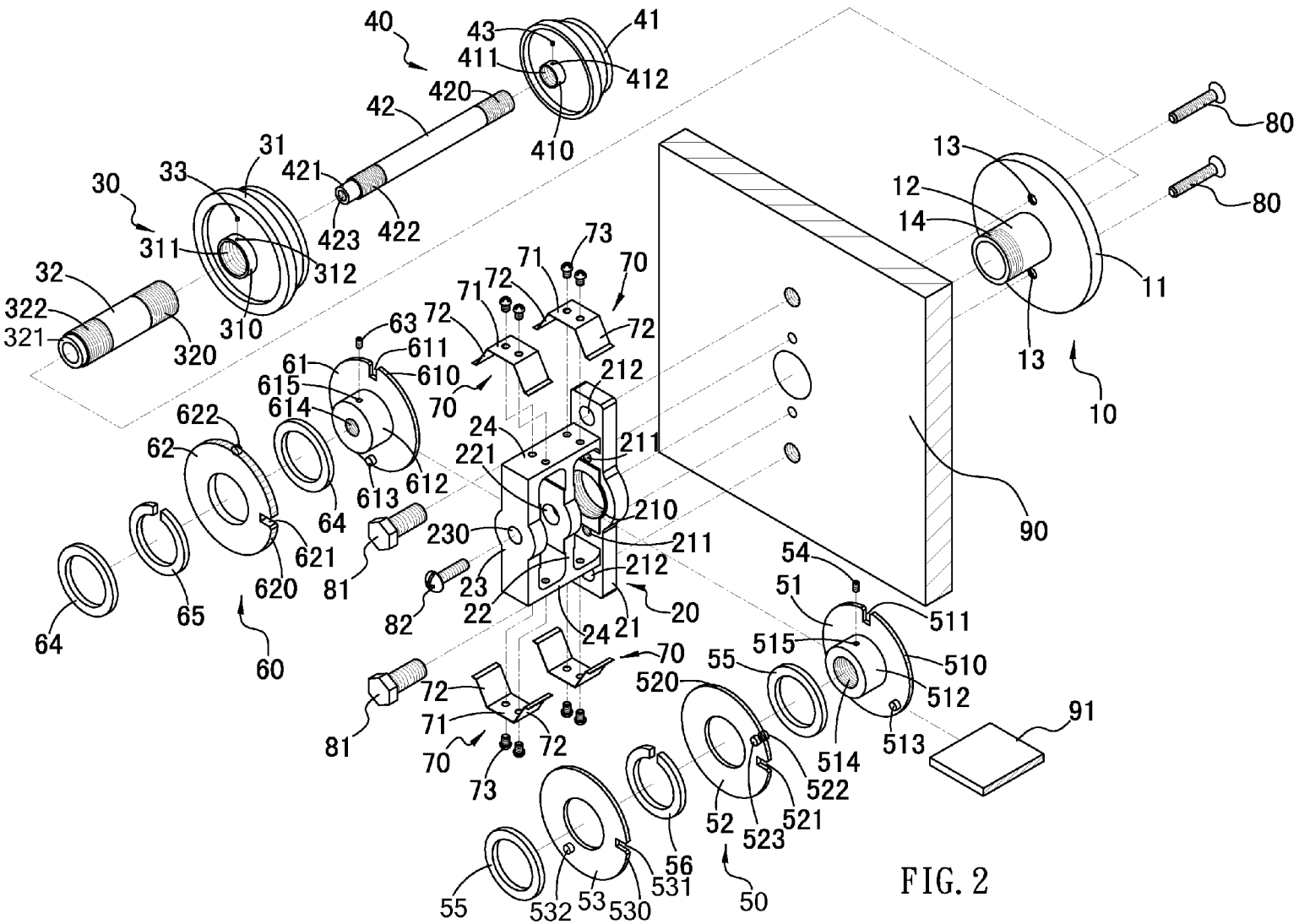
FIG. 2 is an exploded perspective view of the multistage lock apparatus in FIG. 1.
Figure 3:
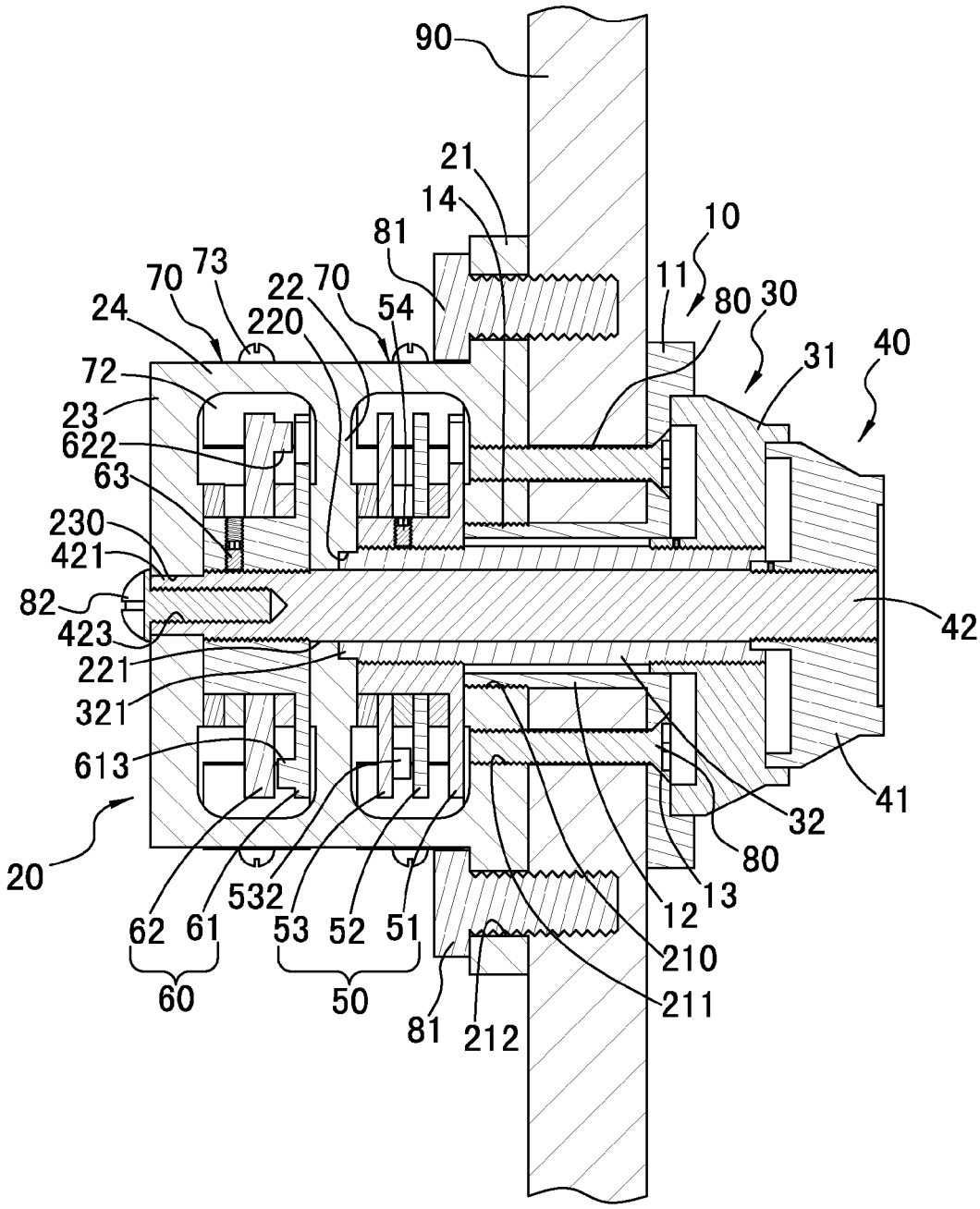
FIG. 3 is a side view of the multistage lock apparatus in FIG. 1.

With reference to FIGS. 1 to 5, a multistage lock apparatus in accordance with the present invention is used on a lock assembly having a door (90) and a lock panel (91) and comprises a base (10), a disk holder (20), two selecting devices (30, 40), two disk sets (50, 60) and at least one interfering element (70).

The door (90) of the lock assembly has an outer surface and an inner surface. The lock panel (91) is movably connected to the door (90).

The base (10) is mounted securely on the door (90) and has a mounting panel (11) and a central tube (12). The mounting panel (11) is mounted on the outer surface of the door (90) and has an inner side, two through holes (13) and two first fasteners (80). The inner side of the mounting panel (11) abuts the outer surface of the door (90). The through holes (13) are formed through the mounting panel (11). The first fasteners (80) extended through the through holes (13) to attach the mounting panel (11) securely on the door (90) of the lock assembly. The central tube (12) is formed on and protrudes from the inner side of the mounting panel (11), extends through the door (90) and has an inner end, an external surface and an outer thread (14). The inner end of the central tube (12) extends through the inner surface of the door (90). The outer thread (14) is formed on the external surface of the central tube (12) near the inner end.

The disk holder (20) is mounted on the door (90), is connected to the base (10) and has a mounting beam (21), two extending beams (24), a middle beam (22), a connecting beam (23), a first mounting space (20*a*) and a second mounting space (20*b*).

The mounting beam (21) is mounted on the inner surface of the door (90) and has a mounting side, a forming side, a central threaded hole (210), two side threaded holes (211), two mounting holes (212) and two second fasteners (81). The mounting side of the mounting beam (21) is mounted on the inner surface of the door (90). The central threaded hole (210) is formed through the mounting beam (21) and is screwed with the outer thread (14) of the central tube (12) of the base (10). The side threaded holes (211) are formed through the mounting beam (21) beside the central threaded hole (210) and are screwed with the first fasteners (80) of the base (10). The mounting holes (212) are formed through the mounting beam (21) beside the side threaded holes (211). The second fasteners (81) are respectively mounted in the mounting holes (212) of the mounting beam (21) and are connected to the door (90) of the lock assembly.

The extending beams (24) are formed on and protrude from the forming side of the mounting beam (21), parallel each other and each extending beam (24) has a middle and a free end. The middle beam (22) is formed on the middles of the extending beams (24) parallel the mounting beam (21) and has two sides, a mounting recess (220) and a pivotal hole (221). The mounting recess (220) is formed in one of the sides of the middle beam (22) and faces to the central threaded hole (210) of the mounting beam (21). The pivotal hole (221) is formed through the other side of the middle beam (22) and communicates with the mounting recess (220). The connecting beam (23) is formed on the free ends of the extending beams (24) parallel the middle beam (22) and has a rod hole (230). The rod hole (230) is formed through the connecting beam (23) and aligns with the pivotal hole (221) of the middle beam (22). The first mounting space (20*a*) is formed between the mounting beam (21), the middle beam (22) and the extending beams (24). The first mounting space (20*b*) is formed between the middle beam (22), the connecting beam (23) and the extending beams (24).

The selecting devices (30, 40) are included a first selecting device (30) and a second selecting device (40).

The first selecting device (30) is rotatably connected to the base (10) and has a driving sleeve (32), a first selecting disk (31) and a positioning bolt (33). The driving sleeve (32) rotatably extends through the central tube (12) of the base (10) and has an outer end, an inner end, an external surface, a disk thread (320), a mounting protrusion (321) and a tube thread (322). The outer end of the driving sleeve (32) extends out of the mounting panel (11) of the base (10). The inner end of the driving sleeve (32) extends out of the central tube (12) of the base (10) in the first mounting space (20*a*) of the disk holder (20). The disk thread (320) is formed on the external surface of the driving sleeve (32) near the outer end. The mounting protrusion (321) is formed on the inner end of the driving sleeve (32) and is pivotally mounted in the mounting recess (220) of the middle beam (22) of the disk holder (20). The tube thread (322) is formed on the external surface of the driving sleeve (32) near the mounting protrusion (321) and is mounted in the first mounting space (20*a*) of the disk holder (20).

The first selecting disk (31) is rotatably mounted on the mounting panel (11) of the base (10), is connected securely to the driving sleeve (32) and has an outer side, an inner side, multiple number signs, a mounting tube (310), a screwed hole (311) and a positioning threaded hole (312). The number signs are formed around the first selecting disk (31) near the outer side. The mounting tube (310) is formed on and protrudes from the inner side of the first selecting disk (31) and has an external surface. The screwed hole (311) is formed through the first selecting disk (31) and the mounting tube (310) and is screwed with the disk thread (320) of the driving sleeve (32). The positioning threaded hole (312) is radially formed in the external surface of the mounting tube (310) and communicates with the screwed hole (311). The positioning bolt (33) is mounted in the positioning threaded hole (312) of the first selecting disk (31) and presses against the disk thread (320) of the driving sleeve (32) to hold the first selecting disk (31) securely with the driving sleeve (32).

The second selecting device (40) is rotatably connected to the first selecting device (30) and the disk holder (20) and has a driving rod (42), a second selecting disk (41) and a positioning bolt (43).

The driving rod (42) rotatably extends through the driving sleeve (32) of the first selecting device (30) and has an outer end, an inner end, an external surface, a disk thread (420), a mounting protrusion (421), a tube thread (422), a connecting hole (423) and a third fastener (82). The outer end of the driving rod (42) extends out of the outer end of the driving sleeve (32) of the first selecting device (30). The inner end of the driving rod (42) extends out of the inner end of the driving sleeve (32) in the second mounting space (20*b*) of the disk holder (20). The disk thread (420) is formed on the external surface of the driving rod (42) near the outer end. The mounting protrusion (421) is formed on the inner end of the driving rod (42) and is pivotally mounted in the rod hole (230) of the connecting beam (23) of the disk holder (20). The tube thread (422) is formed on the external surface of the driving rod (42) near the mounting protrusion (421) and is mounted in the second mounting space (20*b*) of the disk holder (20). The connecting hole (423) is axially formed in the mounting protrusion (421) of the driving rod (42). The third fastener (82) is mounted in the connecting hole (423) to hold the driving rod (42) with the disk holder (20).

The second selecting disk (41) is rotatably mounted on the outer side of the first selecting disk (31), is connected securely to the driving rod (42) and has an outer side, an inner side, multiple number signs, a mounting tube (410), a screwed hole (411) and a positioning threaded hole (412). The number signs are formed around the second selecting disk (41) near the outer side. The mounting tube (410) is formed on and protrudes from the inner side of the second selecting disk (41) and has an external surface. The screwed hole (411) is formed through the second selecting disk (41) and the mounting tube (410) and is screwed with the disk thread (420) of the driving rod (42). The positioning threaded hole (412) is radially formed in the external surface of the mounting tube (410) and communicates with the screwed hole (411). The positioning bolt (43) is mounted in the positioning threaded hole (412) of the second selecting disk (41) and presses against the disk thread (420) of the driving rod (42) to hold the second selecting disk (41) securely with the driving rod (42).

The disk sets (50, 60) are respectively mounted on the selecting devices (30, 40) in the mounting specs (20*a*, 20*b*) of the disk holder (20) and include a first disk set (50) and a second disk set (60).

The first disk set (50) is mounted on the driving sleeve (32) of the first selecting device (30) in the first mounting space (20*a*) of the disk holder (20) and has a first driving disk (51), at least one first driven disk (52, 53), a holding bolt (54), two O-rings (55) and a C-ring (56).

The first driving disk (51) is securely mounted on the inner end of the driving sleeve (32) and has a periphery, an inner side, multiple notches (510), a gap (511), a connecting tube (512); a driving post (513), an attaching threaded hole (514) and a position threaded hole (515). The notches (510) are formed on the periphery of the first driving disk (51). The gap (511) is formed on the periphery of the first driving disk (51). The connecting tube (512) is formed on and protrudes from the inner side of the first driving disk (51), is mounted around the inner end of the driving sleeve (32) of the first selecting device (30) and has an external surface. The driving post (513) is formed on and protrudes from the inner side of the first driving disk (51) between the connecting tube (512) and the periphery of the first driving disk (51). The attaching threaded hole (514) is formed through the connecting tube (512) and the first driving disk (51) and is screwed with the tube thread (322) of the driving sleeve (32) of the first selecting device (30). The position threaded hole (515) is radially formed in the external surface of the connecting tube (512) and communicates with the attaching threaded hole (514) of the first driving disk (51).

The at least one first driven disk (52, 53) is rotatably mounted around the connecting tube (512) of the first driving disk (51) and driven by the first driving disk (51). In a preferred embodiment, the first disk set (50) has two first driven disks (52, 53). The first driven disk (52) adjacent to the first driving disk (51) has a periphery two sides, multiple notches (520), a gap (521), a driven post (522) and a driving post (523). The notches (520) are formed on the periphery of the first driven disk (52). The gap (521) is formed on the periphery of the first driven disk (52). The driven post (522) is formed on and protrudes from one of the sides the first driven disk (52) facing the first driving disk (51) and corresponds to and selectively abuts against the driving post (513) on the first driving disk (51). The driving post (523) is formed on and protrudes from the other side of the first driven disk (52) away from the first driving disk (51). The first driven disk (53) far away from the first driving disk (51) has a periphery, two sides, multiple notches (530), a gap (531) and a driven post (532). The notches (530) are formed on the periphery of the first driven disk (53). The gap (531) is formed on the periphery of the first driven disk (53). The driven post (532) is formed on and protrudes from one of the sides of the first driven disk (53) facing the adjacent first driven disk (52) and corresponding to and selectively abuts against the driving post (523) on the adjacent first driven disk (52). With the abutment between the driving posts (513, 523) and the driven posts (522, 532) on the disks (51, 52, 53), the first driven disks (52, 53) will be rotated with the first driving disk (51) when the driving sleeve (32) is rotated by the first selecting disk (31).

The holding bolt (54) is mounted in the positioning threaded hole (515) of the first driving disk (51) and presses against the tube thread (322) of the driving sleeve (32) to hold the first driving disk (51) securely with the driving sleeve (32). The O-rings (55) are rotatably mounted around the connecting tube (512) of the first driving disk (51) between the first driving disk (51), the first driven disks (52, 53) and the middle beam (22) of the disk holder (20). The C-ring (56) is rotatably mounted around the connecting tube (512) of the first driving disk (51) between the first driven disks (52, 53) and has a slit near the positioning threaded hole (515) of the first driving disk (51).

The second disk set (60) is mounted on the driving rod (42) of the second selecting device (40) in the second mounting space (20*b*) of the disk holder (20) and has a second driving disk (61), a second driven disk (62), a holding bolt (63), two O-rings (64) and a C-ring (65).

The second driving disk (61) is securely mounted on the inner end of the driving rod (42) and has a periphery an inner side, multiple notches (610), a gap (611), a connecting tube (612), a driving post (613), an attaching threaded hole (614) and a position threaded hole (615). The notches (610) are formed on the periphery of the second driving disk (61). The gap (611) is formed on the periphery of the second driving disk (61). The connecting tube (612) is formed on and protrudes from the inner side of the second driving disk (61), is mounted around the inner end of the driving rod (42) of the second selecting device (40) and has an external surface. The driving post (613) is formed on and protrudes from the inner side of the second driving disk (61) between the connecting tube (612) and the periphery of the second driving disk (61). The attaching threaded hole (614) is formed through the connecting tube (612) and the second driving disk (61) and is screwed with the tube thread (422) of the driving rod (42) of the second selecting device (40). The position threaded hole (615) is radially formed in the external surface of the connecting tube (612) and communicates with the attaching threaded hole (614) of the second driving disk (61).

The second driven disk (62) is rotatably mounted around the connecting tube (612) of the second driving disk (61) and driven by the second driving disk (61) and has a periphery, two sides, multiple notches (620), a gap (621) and a driven post (622). The notches (620) are formed on the periphery of the second driven disk (62). The gap (621) is formed on the periphery of the second driven disk (62). The driven post (622) is formed on and protrudes from one of the sides the second driven disk (62) facing the second driving disk (61) and corresponds to and selectively abuts against the driving post (613) on the second driving disk (61). The holding bolt (63) is mounted in the positioning threaded hole (615) of the second driving disk (61) and presses against the tube thread (422) of the driving rod (42) to hold the second driving disk (61) securely with the driving rod (42). The O-rings (64) are rotatably mounted around the connecting tube (612) of the second driving disk (61) between the second driving disk (61), the second driven disk (62) and the connecting beam (23) of the disk holder (20). The C-ring (65) is rotatably mounted around the connecting tube (612) of the second driving disk (61) between the second driving disk (61) and the driven disk (62) and has a slit near the positioning threaded hole (615) of the second driving disk (61).

The at least one interfering element (70) is mounted securely on the disk holder (20) and each of the at least one interfering element (70) has a mounting tab (71) and two elastic panels (72). The mounting tab (71) is mounted securely on one of the extending beams (24) of the disk holder (20) by multiple fixed bolts (73) and has two opposite edges. The elastic panels (72) are respectively and aslant formed on the opposite edges of the mounting tab (71) to contact the notches (510, 520, 530, 610, 620) of one of the disks (51, 52, 53, 61, 62) of the disk sets (50, 60).

Figure 4A:
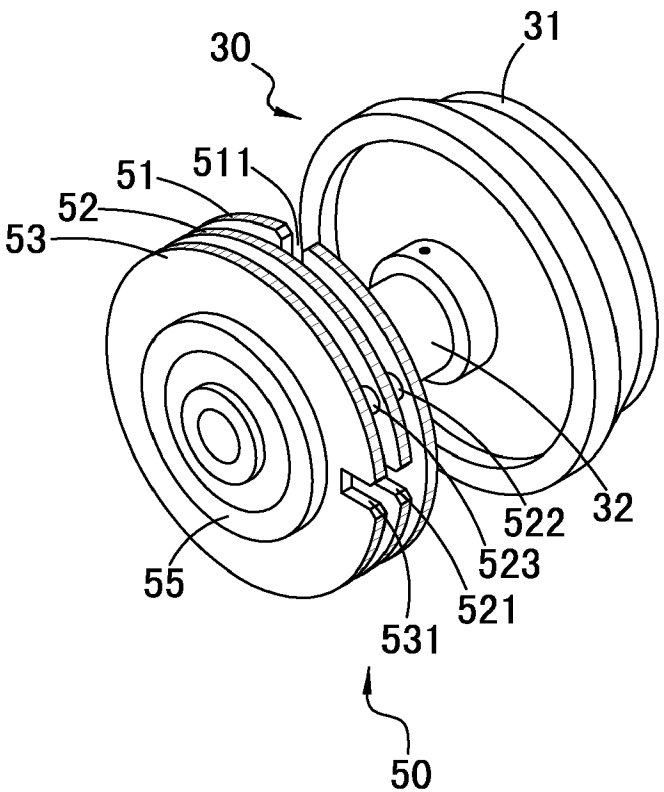
FIGS. 4A and 4B are perspective views of selecting devices and disk sets of the multistage lock apparatus in FIG. 1.
Figure 4B:
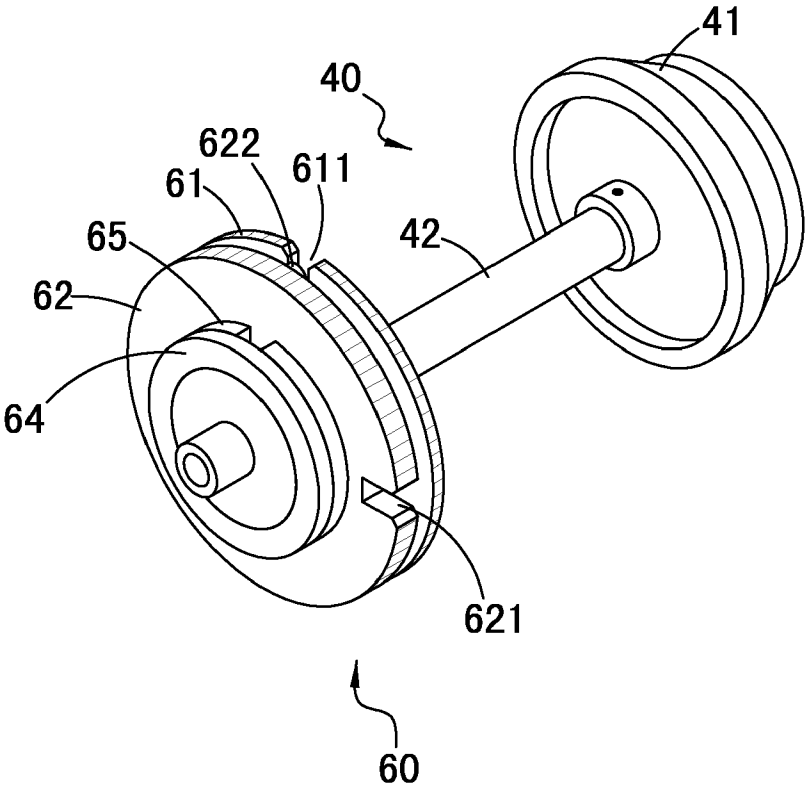
Figure 5:
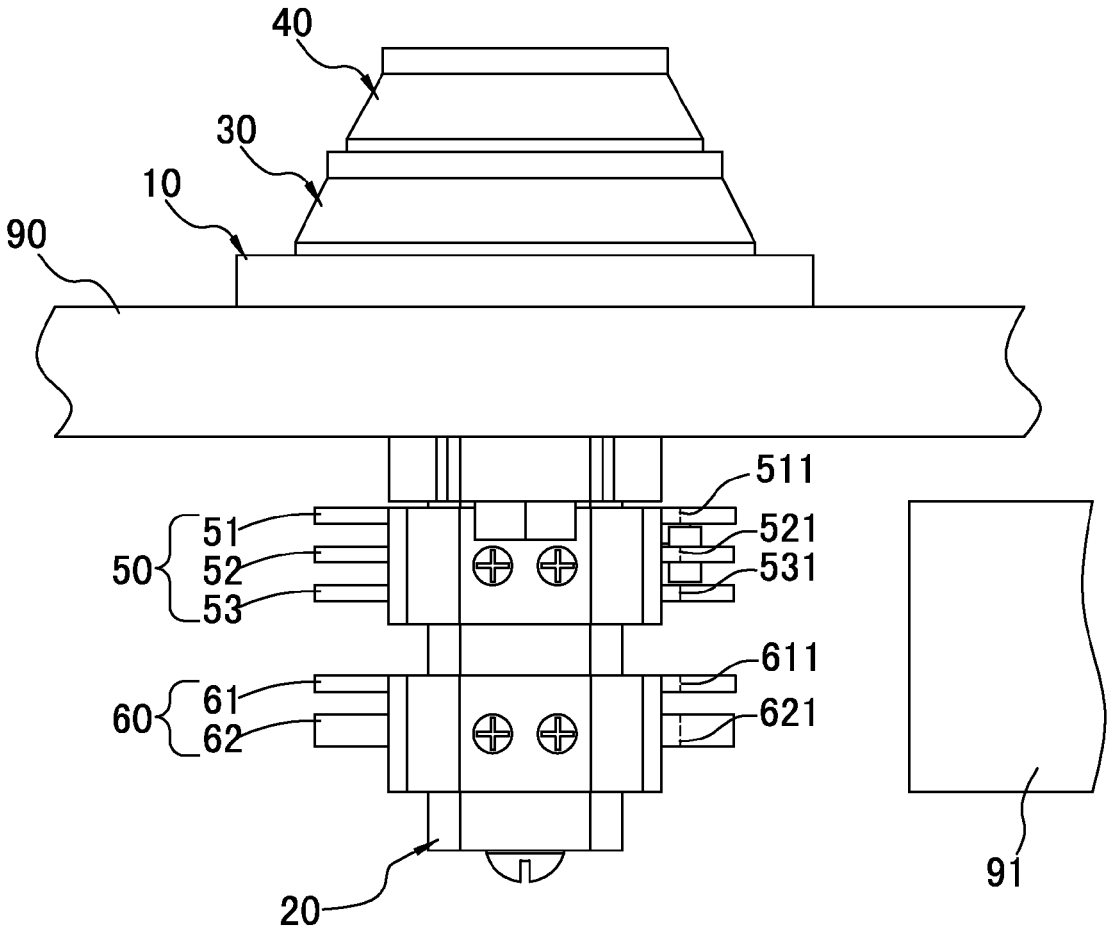
FIG. 5 is an enlarged top view of the multistage lock apparatus in FIG. 1.

With reference to FIGS. 4A and 4B, when the first selecting disk (31) is rotated, the first driving disk (51) is rotated. When the driving post (513) on the first driving disk (51) abuts against the driven post (522) on the adjacent first driven disk (52), the adjacent first driven disk (52) will rotate with the first driving disk (51). When the driving post (523) on the first driven disk (52) adjacent to the first driving disk (51) abuts against the driven post (532) on the other first driven disk (53), the first driven disks (52, 53) will be rotated simultaneously. Thus, the gaps (511, 521, 531) in the disks (51, 52, 53) of the first disk set (50) are aligned with each other by means of rotating the first selecting disk (31) in alternative directions. The operation of aligning the gaps (611, 621) in the disks (61, 62) of the second disk set (60) is same as that of the first disk set (50) but by rotating the second selecting disk (41) and further description is omitted.

Figure 6:
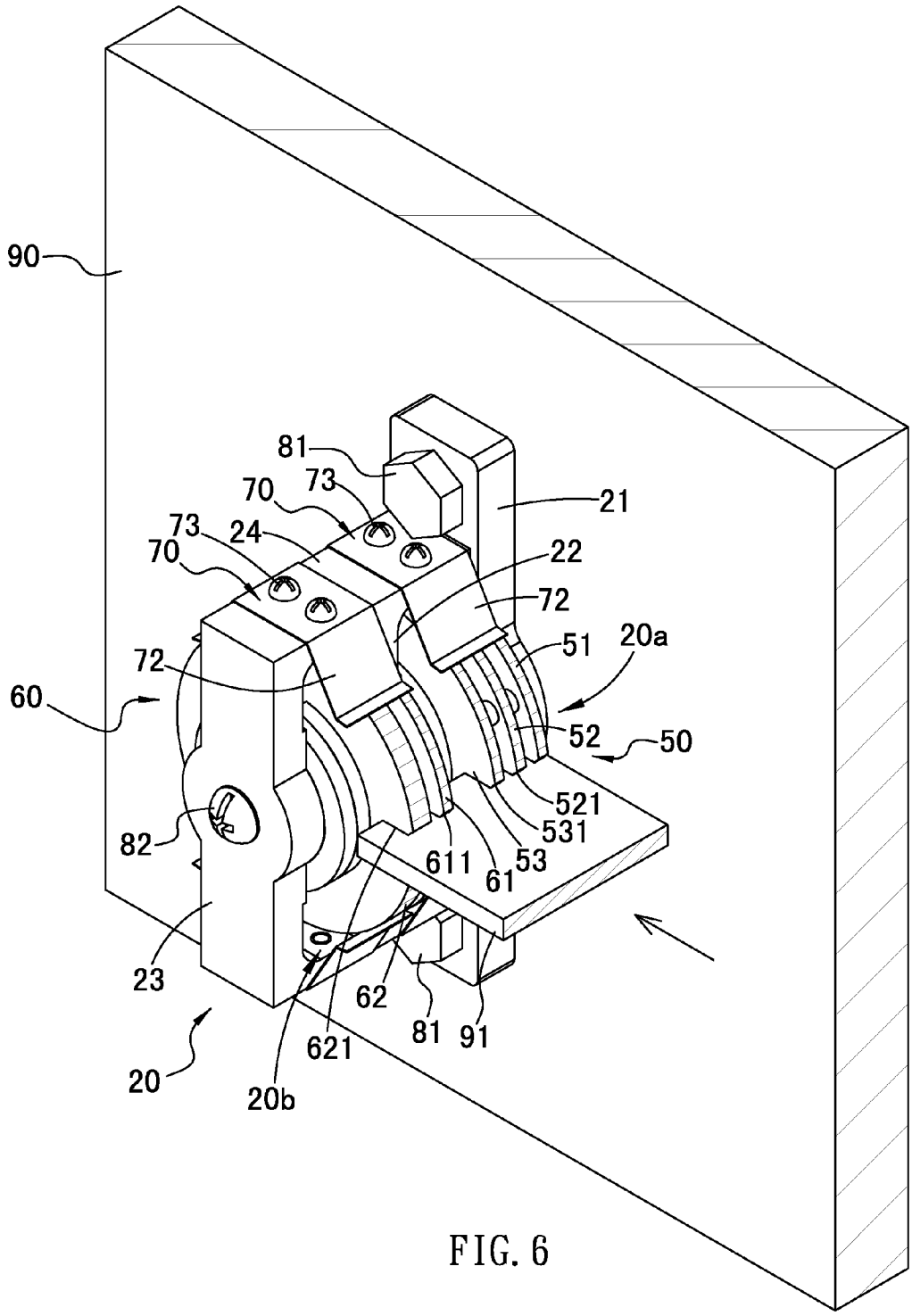
FIG. 6 is an operational perspective view of the multistage lock apparatus in FIG. 1 when unlocking the lock device.
Figure 7:
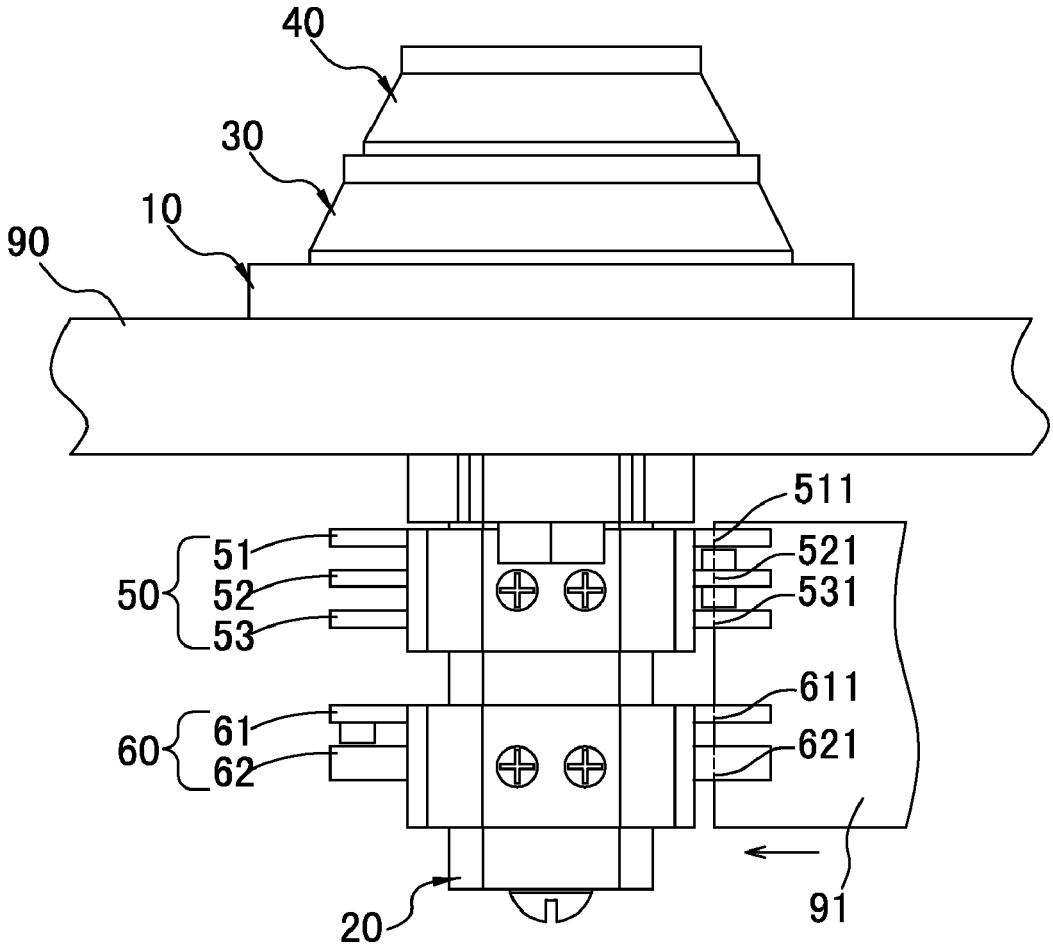
FIG. 7 is a top view of the multistage lock apparatus in FIG. 6.

With reference to FIGS. 6 and 7, when the gaps (511, 521, 531, 611, 621) in the disks (51, 52, 53, 61, 62) of both disk sets (50, 60) are aligned with each other, a space for the lock panel (91) of the lock assembly extending into is defined. When the lock panel (91) of the lock assembly is extended into the space implemented by the gaps (511, 521, 531, 611, 621) of the disks (51, 52, 53, 61, 62), the lock panel (91) is escaped from a lock cavity so that the lock assembly with the multistage lock apparatus is in an unlocked condition. On the contrary, when the disks (51, 52, 53, 61, 62) are rotated to make the gaps (511, 521, 531, 611, 621) misaligning with each other, the lock panel (91) will not be escaped from the lock cavity so that the lock assembly with the multistage lock apparatus is in a locked condition. Accordingly, to unlock the multistage lock apparatus needs five passwords or aligning the gaps (511, 521, 531, 611, 621), so the lock assembly with the multistage lock apparatus is difficult unlocked by unauthorized person. In addition, the disks (51, 52, 53, 61, 62) of the disk sets (50, 60) can be arranged in different amounts, so to unlock the multistage lock apparatus is very complicated for any person who does not know passwords and the safety of using the multistage lock apparatus is improved. For example, when the first disk set (50) has four disks and the second disk set (60) has four disks, the group amount of the passwords of the multistage lock apparatus will be 15376000000000.

With further reference to FIGS. 4A and 4B, each one of the disk sets (50, 60) of the multistage lock apparatus has a password group. When the user needs to unlock the lock assembly frequently, he can operate one of the disk sets (50, 60) in advance with the corresponding correct password group. Then, the user only need to rotate the other disk set (50, 60) in the unlock condition. In addition, the two password groups of the disk sets (50, 60) of the multistage lock apparatus can be held by different persons to increase the safety of using the multistage lock apparatus with the lock assembly. In addition, the multistage lock apparatus may have three or more than one interfering element (70) mounted on the disk holder (20) to generate additional sound when the disks (51, 52, 53, 61, 62) rotate relative to the disk holder (20) and contact with the notches (510, 520, 530, 610, 620) of the disks (51, 52, 53, 61, 62). Accordingly, with the increase of the amount of the interfering element (70), to unlock the multistage lock apparatus is more complicated and difficult.

What is claimed is:

1. A multistage lock apparatus for a lock assembly having a door with an outer surface and an inner surface the multistage lock apparatus comprising:

a base being adapted to mount on the door and having a mounting panel being adapted to mount on the outer surface of the door and having an inner side being adapted to abut the outer surface of the door;

multiple through holes formed through the mounting panel; and multiple first fasteners extended through the through holes to attach the mounting panel securely on the door of the lock assembly; and a central tube formed on and protruding from the inner side of the mounting panel, extending through the door and having an inner end extending through the inner surface of the door;

an external surface; and an outer thread formed on the external surface of the central tube near the inner end;

a disk holder being adapted to mount on the door, connected to the base and having a mounting beam being adapted to mount on the inner surface of the door and having a mounting side being adapted to mount on the inner surface of the door;

a forming side;

a central threaded hole formed through the mounting beam and screwed with the outer thread of the central tube of the base;

multiple side threaded holes formed through the mounting beam beside the central threaded hole and screwed with the first fasteners of the base;

multiple mounting holes formed through the mounting beam beside the side threaded holes; and multiple second fasteners mounted in the mounting holes of the mounting beam to connect with the door of the lock assembly;

two extending beams formed on and protruding from the forming side of the mounting beam, parallel to each other and each extending beam having a middle; and a free end;

a middle beam formed on the middles of the extending beams parallel to the mounting beam and having two sides;

a mounting recess formed in one of the sides of the middle beam and facing to the central threaded hole of the mounting beam; and a pivotal hole formed through the other side of the middle beam and communicating with the mounting recess, a connecting beam formed on the free ends of the extending beams parallel the middle beam and having a rod hole formed through the connecting beam and aligning with the pivotal hole of the middle beam;

a first mounting space formed between the mounting beam, the middle beam and the extending beams; and a second mounting space formed between the middle beam, the connecting beam and the extending beams;

a first selecting device rotatably connected to the base and having a driving sleeve rotatably extending through the central tube of the base and having an outer end extending out of the mounting panel of the base, an inner end extending out of the central tube of the base in the first mounting space of the disk holder;

an external surface;

a mounting protrusion formed on the inner end of the driving sleeve and pivotally mounted in the mounting recess of the middle beam of the disk holder; and a tube thread formed on the external surface of the driving sleeve near the mounting protrusion and mounted in the first mounting space of the disk holder; and a first selecting disk rotatably mounted on the mounting panel of the base and connected securely to the driving sleeve, a second selecting device rotatably connected to the first selecting device and the disk holder and having a driving rod rotatably extending through the driving sleeve of the first selecting device and having an outer end extending out of the outer end of the driving sleeve of the first selecting device;

an inner end extending out of the inner end of the driving sleeve in the second mounting space of the disk holder;

an external surface;

a mounting protrusion formed on the inner end of the driving rod and pivotally mounted in the rod hole of the connecting beam of the disk holder;

a tube thread formed on the external surface of the driving rod near the mounting protrusion and mounted in the second mounting space of the disk holder;

a connecting hole axially formed in the mounting protrusion of the driving rod; and a third fastener mounted in the connecting hole to hold the driving rod with the disk holder; and a second selecting disk rotatably mounted on the outer side of the first selecting disk and connected securely to the driving rod;

a first disk set mounted on the driving sleeve of the first selecting device in the first mounting space of the disk holder and having first driving disk securely mounted on the inner end of the driving sleeve and having a periphery;

an inner side;

a gap formed on the periphery of the first driving disk;

a connecting tube formed on and protruding from the inner side of the first driving disk, mounted around the inner end of the driving sleeve of the first selecting device and having an external surface; and an attaching threaded hole formed through the connecting tube and the first driving disk and screwed with the tube thread of the driving sleeve of the first selecting device; and at least one first driven disk rotatably mounted around the connecting tube of the first driving disk and driven by the first driving disk and each of the at least one first driven disk having a periphery;

two sides; and a gap formed on the periphery of the at least one first driven disk; and a second disk set mounted on the driving rod of the second selecting device in the second mounting space of the disk holder and having a second driving disk securely mounted on the inner end of the driving rod and having a periphery;

an inner side;

a gap formed on the periphery of the second driving disk;

a connecting tube formed on and protruding from the inner side of the second driving disk, mounted around the inner end of the driving rod of the second selecting device and having an external surface; and an attaching threaded hole formed through the connecting tube and the second driving disk and screwed with the tube thread of the driving rod of the second selecting device; and a second driven disk rotatably mounted around the connecting tube of the second driving disk and driven by the second driving disk and having a periphery;

two sides; and a gap formed on the periphery of the second driven disk.

2. The multistage lock apparatus as claimed in claim 1, wherein the first driving disk has multiple notches formed on the periphery of the first driving disk;

each of the at least one first driven disk has multiple notches formed on the periphery of the first driven disk, the second driving disk has multiple notches formed on the periphery of the second driving disk;

the second driven disk has multiple notches formed on the periphery of the second driven disk, and the multistage lock apparatus has at least one interfering element mounted securely on the disk holder and each of the at least one interfering element having at least one elastic panel to contact the notches of one of the disks of the disk sets.

3. The multistage lock apparatus as claimed in claim 2, wherein each of the at least one interfering element has a mounting tab mounted securely on one of the extending beams of the disk holder; and multiple fixed bolts mounted in the mounting tab and the corresponding extending beam; and the at least one elastic panel of each of the at least one interfering element is aslant formed on the mounting tab.

4. The multistage lock apparatus as claimed in claim 3, wherein the first driving disk has a positioning threaded hole radially formed in the external surface of the connecting tube and communicating with the attaching threaded hole of the first driving disk;

the first disk set has a holding bolt mounted in the positioning threaded hole of the first driving disk and pressed against the tube thread of the driving sleeve to hold the first driving disk securely with the driving sleeve;

the second driving disk has a positioning threaded hole radially formed in the external surface of the connecting tube and communicating with the attaching threaded hole of the second driving disk; and the second disk set has a holding bolt mounted in the positioning threaded hole of the second driving disk and pressed against the tube thread of the driving rod to hold the second driving disk securely with the driving rod.

5. The multistage lock apparatus as claimed in claim 4, wherein the driving sleeve has a disk thread formed on the external surface of the driving sleeve near the outer end;

the first selecting disk has an outer side;

an inner side;

a mounting tube formed on and protruding from the inner side of the first selecting disk and having an external surface;

a screwed hole formed through the first selecting disk and the mounting tube and screwed with the disk thread of the driving sleeve; and a positioning threaded hole radially formed in the external surface of the mounting tube and communicating with the screwed hole;

the first selecting device has a positioning bolt mounted in the positioning threaded hole of the first selecting disk and pressed against the disk thread of the driving sleeve to hold the first selecting disk securely with the driving sleeve;

the driving rod has a disk thread formed on the external surface of the driving rod near the outer end;

the second selecting disk has an outer side, an inner side;

a mounting tube formed on and protruding from the inner side of the second selecting disk and having an external surface;

a screwed hole formed through the second selecting disk and the mounting tube and screwed with the disk thread of the driving rod; and a positioning threaded hole radially formed in the external surface of the mounting tube and communicating with the screwed hole; and the second selecting device has a positioning bolt mounted in the positioning threaded hole of the second selecting disk and pressed against the disk thread of the driving rod to hold the second selecting disk securely with the driving rod.

6. The multistage lock apparatus as claimed in claim 5, wherein the first selecting disk has multiple number signs formed around the first selecting disk near the outer side; and the second selecting disk has multiple number signs formed around the second selecting disk near the outer side.

7. The multistage lock apparatus as claimed in claim 6, wherein the first driving disk has a driving post formed on and protruding from the inner side of the first driving disk between the connecting tube and the periphery of the first driving disk;

the first disk set has two first driven disks, the first driven disk adjacent to the first driving disk has a driven post formed on and protruding from one of the sides of the first driven disk facing the first driving disk and corresponds to and selectively abutting against the driving post on the first driving disk and a driving post formed on and protruding from the other side of the first driven disk away from the first driving disk, the first driven disk far away from the first driving disk has a driven post formed on and protruding from one of the sides of the first driven disk facing the adjacent first driven disk and corresponding to and selectively abutting against the driving post on the adjacent first driven disk;

the second driving disk has a driving post formed on and protrudes from the inner side of the second driving disk between the connecting tube and the periphery of the second driving disk; and the second driven disk has a driven post formed on and protruding from one of the sides the second driven disk facing the second driving disk and corresponds to and selectively abutting against the driving post on the second driving disk.

8. The multistage lock apparatus as claimed in claim 7, wherein the first disk set has two O-rings rotatably mounted around the connecting tube of the first driving disk between the first driving disk, the first driven disks and the middle beam of the disk holder; and a O-ring rotatably mounted around the connecting tube of the first driving disk between the first driven disks and having a slit near the positioning threaded hole of the first driving disk; and the second disk set two O-rings rotatably mounted around the connecting tube of the second driving disk between the second driving disk, the second driven disk and the connecting beam of the disk holder; and a O-ring rotatably mounted around the connecting tube of the second driving disk between the second driving disk and the driven disk and having a slit near the positioning threaded hole of the second driving disk.

* * * * *